US007102481B2

(12) United States Patent
Stiekel et al.

(10) Patent No.: US 7,102,481 B2
(45) Date of Patent: Sep. 5, 2006

(54) LOW CURRENT ELECTRIC MOTOR PROTECTOR

(75) Inventors: Jan J. Stiekel, Coevorden (NL); Young-Hwan Park, CheongJu (KR)

(73) Assignee: Sensata Technologies, Inc., Attleboro, MA (US)

( * ) Notice: Subject to any disclaimer, the term of this patent is extended or adjusted under 35 U.S.C. 154(b) by 250 days.

(21) Appl. No.: 10/843,101

(22) Filed: May 11, 2004

(65) Prior Publication Data

US 2005/0122205 A1 Jun. 9, 2005

Related U.S. Application Data

(63) Continuation-in-part of application No. 10/727,297, filed on Dec. 3, 2003, now Pat. No. 6,995,647.

(51) Int. Cl.
*H01H 37/14* (2006.01)
*H01H 37/52* (2006.01)
*H01H 37/04* (2006.01)

(52) U.S. Cl. ..... 337/107; 337/102; 337/112

(58) Field of Classification Search ..... 337/85, 337/36, 89, 97, 100, 101, 102, 107, 112, 113; 29/622

See application file for complete search history.

(56) References Cited

U.S. PATENT DOCUMENTS 3,095,486 A * 6/1963 Perry ..... 337/89
3,430,177 A * 2/1969 Audette ..... 337/365
3,622,930 A * 11/1971 D'Entremont ..... 337/107
3,753,195 A * 8/1973 Woods ..... 337/347
4,015,229 A * 3/1977 Senor et al. ..... 337/107
4,086,558 A * 4/1978 Pejouhy et al. ..... 337/102
4,136,323 A * 1/1979 D'Entremont et al. ..... 337/107
4,224,591 A * 9/1980 Senor ..... 337/102
4,399,423 A * 8/1983 Nield ..... 337/102
4,476,452 A 10/1984 D'Entremont et al.
4,490,704 A * 12/1984 Snider et al. ..... 337/372
D281,240 S * 11/1985 Givler ..... D13/158
4,646,195 A * 2/1987 Lisauskas ..... 361/25
5,206,622 A * 4/1993 Lattari ..... 337/89
D336,072 S * 6/1993 Givler ..... D13/158
5,615,072 A * 3/1997 Hofsass et al. ..... 361/24
5,808,539 A * 9/1998 White ..... 337/379

(Continued)

FOREIGN PATENT DOCUMENTS

JP 2005108585 A * 4/2005

*Primary Examiner*—Anatoly Vortman
(74) *Attorney, Agent, or Firm*—Russell E. Baumann

(57) ABSTRACT

A low current motor protector (10, 10') has an oblong metal housing (12) defining a switch chamber and formed with an open end. The housing has opposing flange portions extending transversely from the open end. Spaced apart lid portions (18*a*, 18*b*; 18*a'*, 18*b'*) are received on and clamped to the flange portions with an electrically insulating gasket (16) having a central opening interposed between the housing and the lid parts. The lid parts are formed with a recessed ceramic heater seat disposed in the switch chamber having spaced apart contact shelves (18*f*) which receives a ceramic heater (20) which is maintained in place and provided with contact force by a spring clip (22, 22') attached to one of the lid parts. In another embodiment a coil heater (30) is electrically connected between lid parts (28*a*, 28*b*) and is disposed in a recess formed by a dome configuration (28*f*). A thermostatic switch is mounted in the housing and has a movable electrical contact movable into and out of engagement with a stationary electrical contact on one of the lid parts.

7 Claims, 7 Drawing Sheets

U.S. PATENT DOCUMENTS 5,936,510 A * 8/1999 Wehl et al. ..... 337/377
5,973,587 A * 10/1999 Hofsass ..... 337/377
6,020,807 A * 2/2000 Givler ..... 337/377
6,744,345 B1 * 6/2004 Korczynski et al. ..... 337/358
6,756,876 B1 * 6/2004 Sullivan et al. ..... 337/111
6,801,116 B1 * 10/2004 Oh et al. ..... 337/112

* cited by examiner

LOW CURRENT ELECTRIC MOTOR PROTECTOR

CROSS REFERENCE TO RELATED APPLICATION

This is a continuation-in-part of application Ser. No. 10/727,297 filed Dec. 3, 2003, now U.S. Pat. No. 6,995,647 assigned to the assignee of this invention.

FIELD OF THE INVENTION

This invention relates generally to motor protectors and more particularly to low current protectors for electrical devices such as compressors, transformers and small motors against overload and locked rotor.

BACKGROUND OF THE INVENTION

It is well known to provide reliable and inexpensive motor protectors that comprise a small housing in which is disposed a small current carrying thermostatic switch having a bimetal disc adapted upon the occurrence of certain thermal conditions to snap into and out of engagement with a stationary contact to respectively close and open an electrical circuit.

In order to make such protectors quickly responsive to very small current levels, it is also known to provide a supplemental heater mounted in heat transfer relation with the disc. An example of this type of protector is shown and described in U.S. Pat. No. 4,476,452 and comprises a metallic housing having an open end with a flange formed around the open end and a gasket and lid received on and clamped to the housing. A heat responsive electrical switch is disposed in the housing and is adapted to electrically connect and disconnect a current path through the housing and lid upon the occurrence of selected thermal conditions. The lid comprises two discrete, spaced apart portions, one portion having an elongated part extended therefrom to serve as a terminal and the other portion mounting a portion of the switch. A coil heater is electrically and mechanically connected between the spaced apart portions of the lid providing a protector particularly useful for fractional horsepower motors.

SUMMARY OF THE INVENTION

Although motor protectors made according to the above referenced patent are suitable for low current applications, there is a need to provide a low cost protector useful for low current applications having even more current sensitivity yet one which is mechanically robust and one which has increased reset times required for certain applications, such as protecting compressor motors.

It is therefore an object of the present invention to provide a low current motor protector which overcomes the above-noted limitations of the prior art. Another object of the invention is the provision of a low current motor protector which has improved current sensitivity, yet is mechanically robust regarding handling and vibration. Yet another object of the invention is the provision of a motor protector of the low current type which can be easily and accurately adapted for use with different electrical devices, such as compressors, transformers and small motors. Yet another object of the invention is the provision of a low current motor protector which is particularly conducive to low cost assembly techniques. Still another object of the invention is the provision of a low current motor protector which has an end of life, open circuit condition.

Briefly, in accordance with the invention, a low current motor protector comprises a generally parallelepiped shaped metal housing defining a switch chamber which has an open end formed with an outwardly, laterally extending flange and in which a thermostatic switch is mounted. A window shaped gasket is received on the flange and first and second spaced apart lid parts are received on and clamped to the flange through the gasket electrically separated from the housing. The lid parts are each formed with a recessed contact shelf in alignment with and facing each other and adapted to receive end portions of a ceramic substrate. A thick film heater is disposed on the lower face surface of the ceramic substrate with contact portions disposed at opposite ends for receipt on the contact shelves of the lid parts. The recessed positioning of the ceramic heater into the switch chamber results in placement of the ceramic heater in optimum heat transfer coupling with the thermostatic switch. According to a feature of the invention, the ceramic substrate increases the thermal mass of the heater to provide an extended reset time for the thermostatic switch. The thermostatic switch has a movable contact which is movable into and out of engagement with a stationary contact mounted on the lower or inside surface of one of the lid portions so that upon selected heating of the thermostatic switch by the ceramic heater the switch will cause the movable contact to move from a contacts engaged or closed position to a contacts disengaged or open position.

The ceramic heater is received on the recessed seat formed by the contact shelves and is held in place by means of a mechanical clip extending across one of the lid portions which applies suitable force on the outer surface of the substrate against the contact shelves for good electrical engagement of the ceramic heater contacts therewith.

In another embodiment a coil heater has one end thereof attached to a first of a two part lid clampingly received on the housing through an electrically insulative gasket and a second end thereof attached to the second of the two part lid also clampingly received on the housing through the gasket. The two part lid has a dome configuration formed in a portion of the otherwise generally planar lid parts along with laterally extending tabs adapted to be bent over to clampingly engage the laterally extending flange portions of the housing through the gasket. The coil heater is received in the recess of the dome configuration in heat transfer relation with the thermostatic switch and the two lid parts are spaced longitudinally from each other sufficiently to maintain electrical separation from each other.

BRIEF DESCRIPTION OF THE DRAWINGS

Other objects, advantages and details of the novel and improved electrical motor protector of this invention appear in the following detailed description referring to the drawings in which.

DETAILED DESCRIPTION OF THE PREFERRED EMBODIMENT

Figure 1:
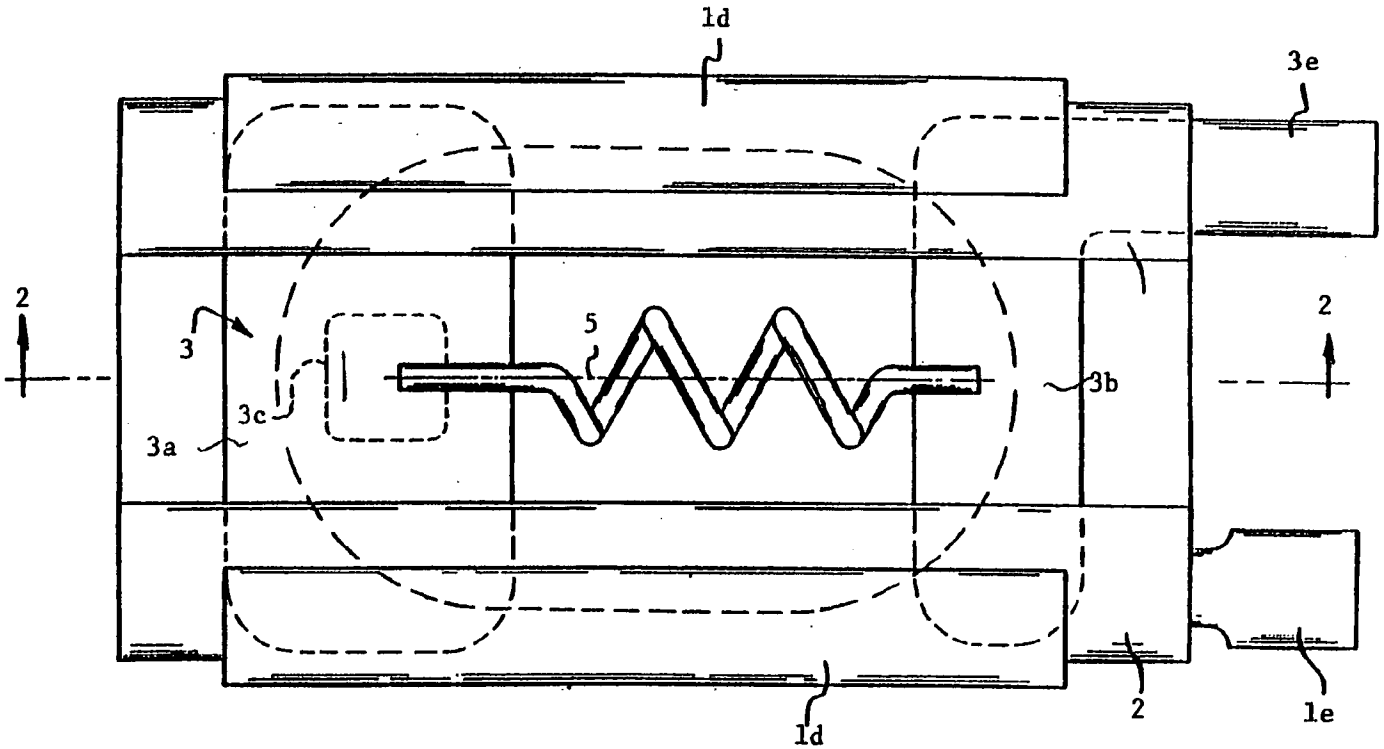
Fig. 1 Prior Art
FIG. 1 is a top plan view of a motor protector made according to the prior art.
Figure 2:
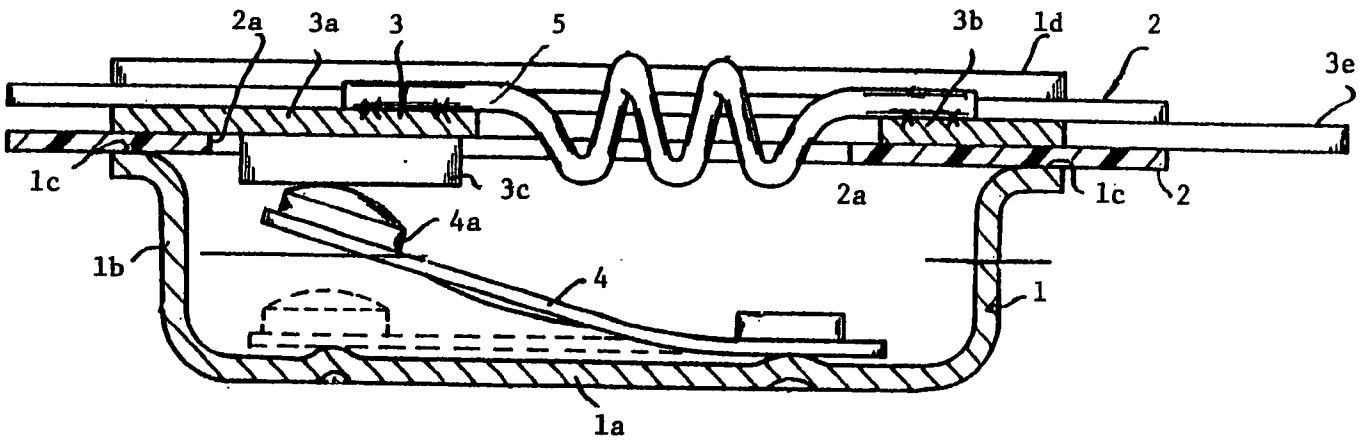
Fig. 2 Prior Art
FIG. 2 is a cross sectional view taken through line 2—2 of FIG. 1.

With reference to FIGS. 1 and 2, a prior art low current motor protector comprises an oblong metallic housing 1 having a bottom wall 1*a*, sidewall 1*b* and a laterally, outwardly extending flange 1*c* at a free end of the sidewall. A gasket 2 of electrically insulating material is received on flange 1*c* and a lid 3 formed of spaced apart parts 3*a*, 3*b* are received on gasket 2. An extended portion 1*d* of flange 1*c* on opposed sides of the housing are bent over to clamp the lid parts 3*a*, 3*b*, through the gasket.

Gasket 2 is formed with a window 2*a* aligned with a switch chamber defined by the sidewall 1*b* of the housing and a thermostatic switch comprising a snap-acting bimetallic member 4 has one end fixedly mounted on the bottom wall 1*a* of the housing and a free distal end mounting a movable electrical contact 4*a* movable into and out of engagement with stationary contact 3*c* welded to lid part 3*a*.

A supplemental coil heater 5 has one end welded to lid part 3*b* and an opposite end welded to lid part 3*a*. Lid part 3*b* is formed with a terminal portion 3*e* and housing 1 is formed with a terminal 1*e*.

Movable contact 4*a* is normally in electrical engagement with stationary electrical contact 3*c* thereby forming a current path between the terminals through bimetal 4 and coil heater 5; however, upon being heated to a selected temperature, for example, due to an overload current, disc 4 will snap to its dashed line configuration to open the circuit.

Although the prior art motor protector described above is effective for certain applications, a protector having even more current sensitivity is desired in order to be useful in a wider market range. This requires increased resistance of the heater which could be obtained by decreasing the cross sectional area of the coil heater; however, this results in heater elements which are too fragile for normal handling. Further, in order to be useful in certain markets such as compressors having positive temperature coefficient (PTC) starting devices, a longer off or reset time is needed to allow appropriate cooling of the PTC starting device.

Figure 3:
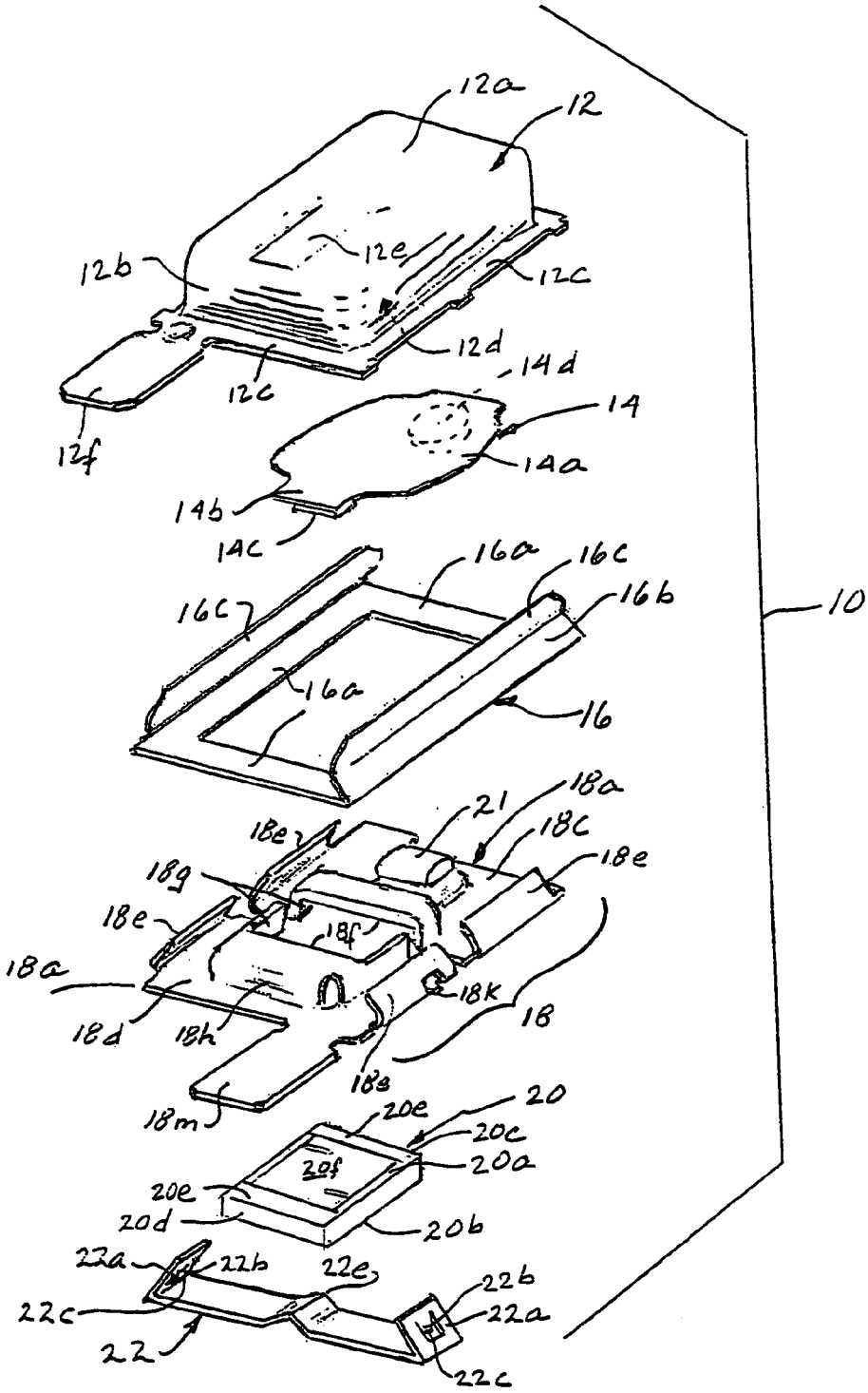
FIG. 3 is a blown apart perspective of a motor protector made in accordance with a preferred embodiment of the invention.

These limitations are overcome by a protector made in accordance with the present invention. As shown in FIG. 3, a motor protector 10 comprises a metallic oblong housing 12 having a bottom wall 12*a*, sidewalls 12*b* extending away from the bottom wall and having a flange 12*c* extending laterally and outwardly from the free end of the sidewall.

A thermostatic switch 14 is received in a switch chamber 12*d* defined by sidewalls 12*b*. Switch 14 comprises a bimetallic, snap acting disc 14*a*, known in the art, having one end 14*b* cantilever attached to the bottom wall 12*a* of the housing, preferably at an inwardly extending platform 12*e*, as by welding thereto using welding slug 14*c*. A movable electrical contact 14*d* is mounted at the free end 14*e* of the disc on the side thereof facing away from the bottom wall of the housing.

An electrically insulating gasket 16, generally in a shape of a window frame 16*a*, is received on and covers flange 12*c* of the housing. The gasket has an extended portion 16*b* along two elongated opposite sides which are folded back toward the center of the window frame configuration into a generally V-shape in order to sandwich two opposed flange portions of the housing between layers 16*a* and 16*b*. Preferably, an additional portion 16*c* extends from extended portion 16*b* for placement along the sidewalls 12*b* of the housing to ensure electrical isolation between lid parts, to be discussed, and the housing.

A lid 18 comprises first and second parts 18*a*, 18*b*, respectively. Each lid part has a flat support portion 18*c*, 18*d*, respectively, lying in a plane, for reception on the frame gasket portion 16*a* on flange 12*c* and opposed tabs 18*e* bent back toward the center of the lid part forming a generally a V configuration with the support portion. Tabs 18*e* on lid part 18*b* are formed with a cut-out on the curved portion of the bend of the tabs to define catch surfaces 18*k* lying in the plane of support portion 18*d* extending into the cut-out for a purpose to be described.

Each lid part is formed with a heater seat in the form of a contact shelf 18*f* spaced from the plane in which the respective support portion 18*c*, 18*d*, lie on the side of the lid parts facing the switch chamber so that the shelves are disposed within the switch chamber 12*d* when the lids are placed on the housing. Respective side and back walls 18*g*, 18*h* are joined to the shelves to ensure a robust seat for maintaining a selected location of a heater element. Shelves 18*f* are aligned and face each other and are spaced from each other a selected amount to provide direct, close, radiational heat coupling of a heat element received on the shelves with snap acting thermostatic disc 14*a*.

A heater element in the form of a ceramic substrate 20 has opposed first and second face surfaces 20*a*, 20*b* and first and second ends 20*c*, 20*d*, respectively. An electrical contact layer 20*e* of suitable material, such as a silver containing material, preferably formed with external contact bumps, extends across each end 20*c*, 20*d* on first face surface 20*a* and an electrical resistive thick film layer 20*f* covered by a glass layer is disposed on the first face surface 20*a* extending between and in electrical connection with the contact layers. The contact layers of the ceramic substrate are adapted to be received on ledges 18*f* with the ceramic element closely fitting in the recessed seat and with the heater surface facing thermostatic disc 14*a*.

A stationary electrical contact 21 is mounted preferably on a platform formed in support portion 18*c* of lid part 18*a* on the side of the lid part having shelf 18*f*. Movable contact 14*d* is adapted to move into and out of engagement with stationary contact 21 in dependence upon the dished configuration of the thermostatic disc 14*a*.

A spring clip 22 is formed of suitable material such as stainless steel and generally has an elongated body portion to extend across the width of housing 12 with opposite end portions 22*a* bent back on themselves to form a generally V configuration with the body portion and a locking tab 22*b* is struck out from each bent over portion with the free end 22*c* of the tab extending away from the free end of each locking tab portion 22*b*. A force application portion in the form of a projection 22*e* extends away from the body portion of clip 22 on the same side of the clip that end portions 22*a* are bent to extend.

One terminal 12*f* extends from housing 12 and another terminal 18*m* extends from lid part 18*b*.

Once thermostatic switch 14 is mounted in switch chamber 12*d*, gasket 16 is slipped onto flange 12*c* followed by lid parts 18*a*, 18*b* with V-shaped tabs 18*e* slipped over gasket 16, including portion 16*b*. The lid parts are spaced from one another a selected distance sufficient to ensure electrical separation and with ledges 18*f* property spaced from each other to receive ceramic substrate 20 thereon with the contact surfaces 20*e* received on respective shelves 18*f*. Tabs 18*e* are then bent inwardly to clamp the lid parts in their selected positions. The ceramic substrate is then inserted and clip 22 is placed over lid portion 18*b* so that end portions 22*a* are received over-tabs 18*e* and with struck out locking tab 22*b* received under respective catch surfaces 18*k* and with force application portion 22*e* placing a force on face 20*b* of ceramic substrate 20.

Figure 4:
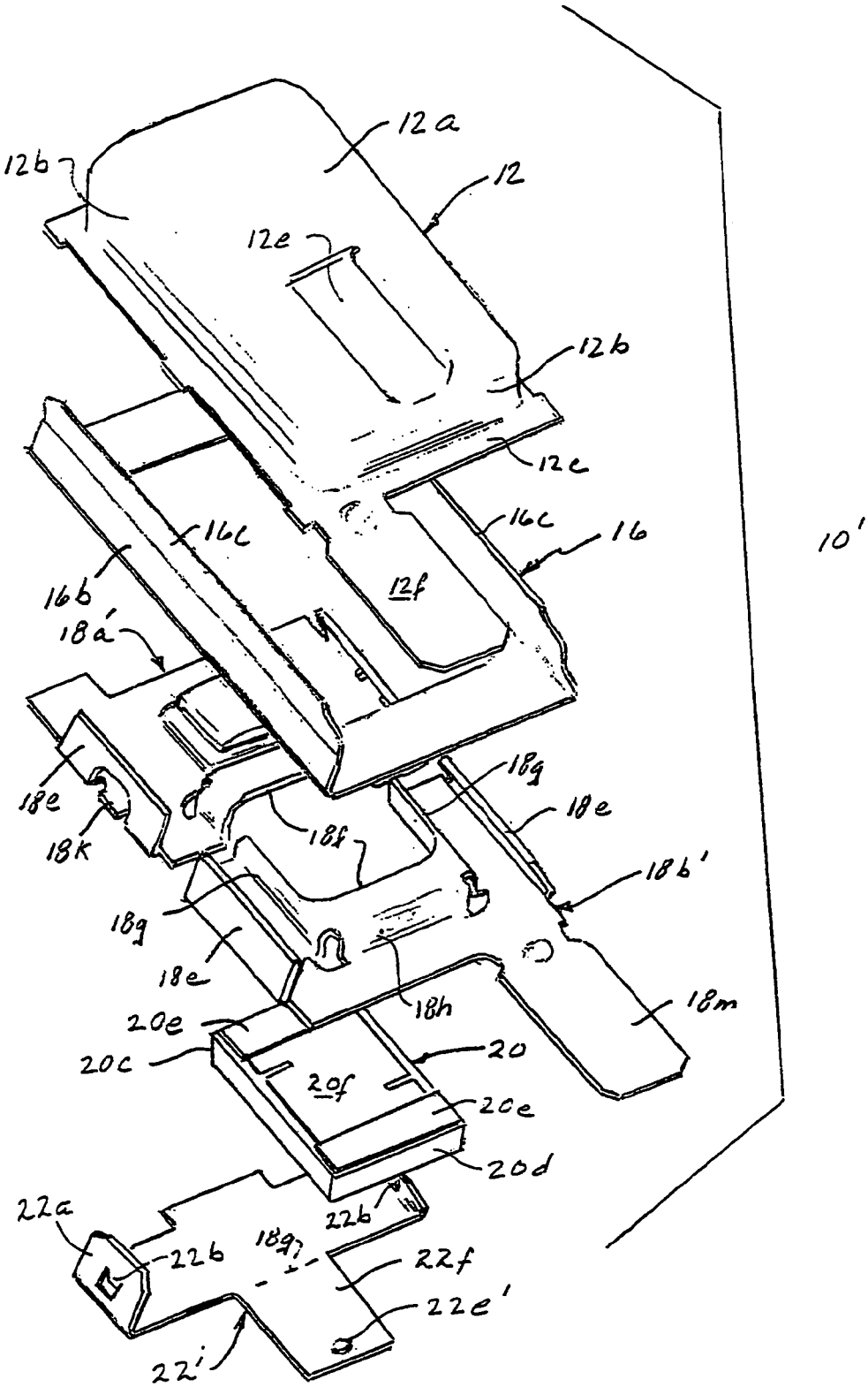
FIG. 4 is similar to FIG. 3 of a modified embodiment of the invention but shown without the thermostatic switch.

FIG. 4 shows a modified embodiment 10' in which catch surfaces 18*k* are formed in lid portion 18*a'* and clip 22' is formed with a leg portion 22*f* for positioning force application projection 22*e'* so that it will be aligned with the center of ceramic substrate 20 when clip 22' is attached to lid part 18*a'*. Leg 22*f* may be bent upwardly, as shown in the drawing, for example, along dashed line 18*g*, to provide a suitable bias to the ceramic substrate.

Motor protector 10, 10' made in accordance with the preferred embodiments offer a number of advantages over the prior art. The cross section of the heater material is decreased to provide increased resistance making the protector more current sensitive but without loosing robustness. The ceramic substrate adds thermal mass to the heater element to increase the reset time of the thermostatic switch, a feature which is important for certain applications, for example, those with compressors which require an extended cool down time for a PTC starter. Placement of the heater in a recess formed in the switch chamber of the housing provides optimum thermal coupling with the thermostatic switch as well as providing a seat for the heater protected from accidental dislodgement during handling, vibration and the like.

The thick film heater provides a fail safe end of life, i.e., burn out of the heater material or breaking of the ceramic substrate results in an open circuit. Use of the thick film heater also provides an advantage in that the heater film can be trimmed to provide accurate resistance values resulting in accurate time behavior. Further, laser trimming allows more flexibility in defining the nominal resistance value and can be used with the wider range of values than a corresponding coil heater and hence can be used in a wider range of applications.

The use of the spring clip to maintain the ceramic heater in its seat ensures optimum electrical and mechanical connection while avoiding welding or soldering operations.

Figure 5:
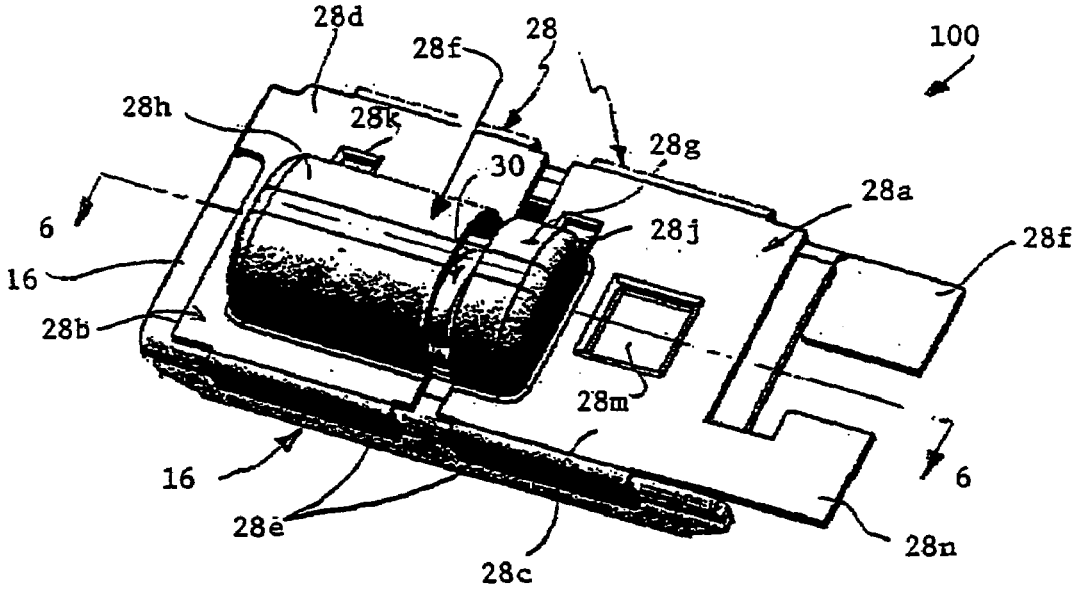
FIG. 5 is a perspective view of the coil heater embodiment made in accordance with another embodiment of the invention.
Figure 6:
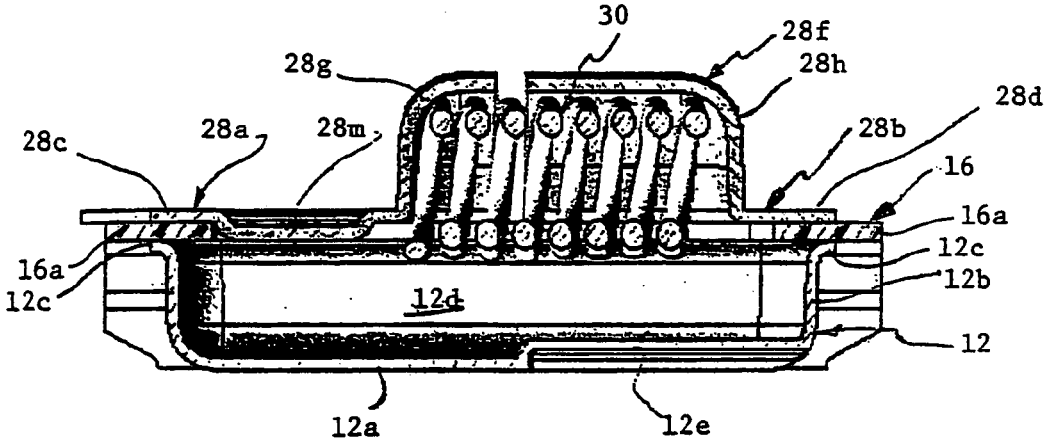
FIG. 6 is a cross sectional view taken along line 6—6 of FIG. 5.
Figure 7:
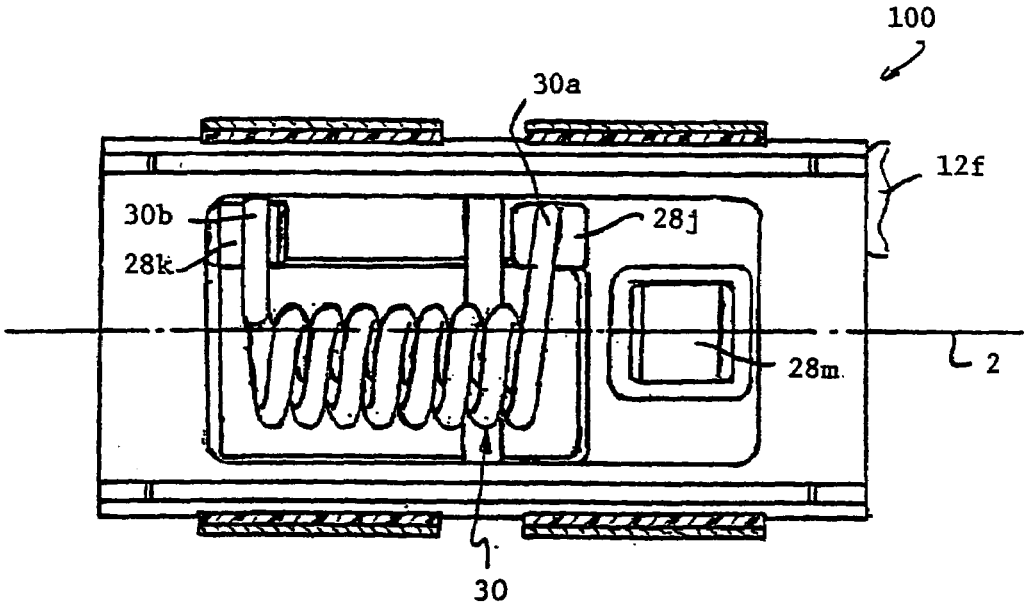
FIG. 7 is a top plan view of the FIG. 5 embodiment with the lid parts cut away for the purpose of illustration.

With reference to FIGS. 5–7, another embodiment 100 of the invention is shown comprising an oblong metal housing 12, as shown in the previous embodiments. Housing 12 has bottom wall 12*a*, side walls 12*b* extending from the bottom wall, a flange 12*c* extending laterally outwardly from the free end of at least portions of the sidewalls along with a terminal 12*f* extending longitudinally from flange 12*c* at one end of the housing.

A thermostatic switch (not shown) of the type shown in FIG. 3 is received in a switch chamber 12*d*, the thermostatic disc member preferably mounted on platform 12*e* of bottom wall 12*a*.

Electrically insulating gasket 16 is received on and covers flange 12*c* of the housing, again as in the previously described embodiments.

A lid 28 of electrically conductive material comprises first and second parts 28*a*, 28*b*, respectively. Each lid part has a flat support portion 28*c*, 28*d*, respectively, lying in a plane for reception on the frame gasket portion 16*a* and flange 12*c* and opposed tabs 28*e* bent inward toward the center of the respective lid part forming a generally V configuration with the support portions, as in the previously described embodiments. A stationary contact platform 28*m* and a terminal 28*n* are formed on lid part 28*a*.

A dome shaped configuration 28*f* is formed in the flat support portion of the lids which extends in a direction generally parallel to the longitudinal axis 2 of oblong housing 12. As shown, dome 28*f* has a first, relatively minor, longitudinal length portion 28*g* in first lid part 28*a* and a second, relatively major, longitudinal length portion 28*h* in second lid part 28*b*.

As best seen in FIG. 7, lid parts 28*a*, 28*b* preferably have a wider flat support surface on one side of the longitudinal axis 2 of the lid to facilitate placement of weld projections 28*j*, 28*k* on respective lid parts while maximizing the available longitudinal space available for the helical configuration of the heater, to be discussed. The weld projections can be formed by local deformation of the flat support portions or by placement of weld slugs, as desired. The wall of dome configuration 28*f* is formed with a cut-out aligned with each weld projection to allow an end of a coil heater to pass through for attachment thereto.

A helical or coil heater 30 has a first end 30*a* and a second end 30*b* attached to respective weld projections 28*j*, 28*k*, as by welding with the helical portion of the heater disposed within the concave recess formed by the dome configuration in direct thermal communication with the thermostatic switch received in housing 12. Lid parts 28*a*, 28*b*, are clamped to housing 12 by means of tabs 28*e* with the lid parts spaced from one another along longitudinal axis 2 enough to provide suitable electrical separation between the two lid parts but otherwise close enough to effectively form an enclosure to retain heat generated by the coil heater for an extended period and thereby extend the off or reset time of the thermostatic switch. Dome configuration 28*f* also serves to protect the coil heater during handling and the like.

While the invention has been described in combination with a specific preferred embodiment thereof, it is evident that many alternatives, modifications and variations will be apparent to those skilled in the art in view of the foregoing description. It is intended that the invention include all modifications and equivalents of the disclosed embodiment falling within the scope of the appended claims.

What is claimed:

1. A motor protector comprising a housing member having a longitudinal axis, a bottom wall, a sidewall extending upwardly from the bottom wall defining an open end and a switch chamber, the sidewall having a free end formed with a laterally, outwardly extending flange having portions on at least two opposite sides of the open end, a thermostatic switch having a movable contact received in the switch chamber electrically connected to the housing member, a gasket received on the flange and having an opening aligned with the open end of the housing member, a lid having first and second spaced apart parts received on the gasket and attached to the housing, at least one of the lid parts formed with a portion having a dome forming a concave configured recess, an elongated heater element having a generally helical configuration and having first and second end portions, the end portions electrically connected to respective spaced apart lid parts and the helical configuration received in and spaced from the concave configured portion of the lid parts.

2. A motor protector according to claim 1 in which the portion of the lid parts forming the concave configuration extends in both the first and second lid parts.

3. A motor protector according to claim 2 in which the dome extends along the longitudinal axis.

4. A motor protector according to claim 3 in which the dome has a relatively minor longitudinal length in one lid part and a relatively major longitudinal length in the other lid part.

5. A motor protector according to claim 1 in which each lid part has two opposite sides formed with tabs receivable over flange portions of the housing and being clamped to the flange portions through the gasket.

6. A motor protector according to claim 1 including a heater element weld projection formed on each lid part.

7. A motor protector according to claim 6 in which the helical configuration of the heater element extends in a direction generally parallel to the longitudinal axis and the end portions of the heater element extend generally laterally.

* * * * *